US006070640A

United States Patent [19]

Miyagawa et al.

[11] Patent Number: 6,070,640

[45] Date of Patent: Jun. 6, 2000

[54] WALK-THROUGH TYPE WATERPROOF SCREEN APPARATUS

[75] Inventors: Yasuyuki Miyagawa, Saitama; Kou Muraoka, Tokyo; Masahiko Honma, Tokyo; Akira Miyake, Tokyo, all of Japan

[73] Assignee: Obayashi Corporation, Osaka, Japan

[21] Appl. No.: 08/945,054

[22] PCT Filed: Feb. 17, 1997

[86] PCT No.: PCT/JP97/00419

§ 371 Date: Oct. 22, 1997

§ 102(e) Date: Oct. 22, 1997

[87] PCT Pub. No.: WO97/35642

PCT Pub. Date: Oct. 2, 1997

[30] Foreign Application Priority Data

| | | | |
|---|---|---|---|
| Mar. 26, 1996 | [JP] | Japan | 8-070561 |
| Jul. 2, 1996 | [JP] | Japan | 8-172689 |
| Jul. 2, 1996 | [JP] | Japan | 8-172690 |
| Jul. 2, 1996 | [JP] | Japan | 8-172691 |
| Jul. 30, 1996 | [JP] | Japan | 8-200079 |

[51] Int. Cl.[7] ..... E06B 9/08

[52] U.S. Cl. ..... 160/121.1; 160/25; 160/349.1

[58] Field of Search ..... 160/121.1, 120, 160/25, 237, 238, 116, 181, 180, 184, 332, 349.1; 169/48, 49

[56] References Cited

U.S. PATENT DOCUMENTS

| | | | |
|---|---|---|---|
| 2,160,118 | 5/1939 | Brent | 160/237 X |
| 3,136,356 | 6/1964 | Mears | 160/237 X |
| 3,766,958 | 10/1973 | Mitchell | 160/1 X |
| 3,872,927 | 3/1975 | Stults | 160/6 X |
| 3,877,525 | 4/1975 | Husson et al. | 160/1 X |
| 3,960,216 | 6/1976 | Isobe | 160/1 X |
| 4,077,474 | 3/1978 | Hattori | 160/1 X |
| 4,313,485 | 2/1982 | Gidge et al. | 160/349.1 X |
| 4,316,345 | 2/1982 | Rivette et al. | 160/180 X |
| 5,195,594 | 3/1993 | Allen et al. | 160/243 X |
| 5,383,510 | 1/1995 | Allen | 160/243 X |
| 5,450,890 | 9/1995 | Pinkalla et al. | 160/121.1 |
| 5,542,463 | 8/1996 | Pinkalla et al. | 160/121.1 X |

*Primary Examiner*—David M. Purol

*Attorney, Agent, or Firm*—Wenderoth, Lind & Ponack, L.L.P.

[57] ABSTRACT

A walk-through type fire-limiting screen arrangement separates an interior space of a building and prevents fire from propagating and assists refugees to escape from the fire. A non-combustible or fire-proof screen droops from a ceiling or a beam. At least one slit extends vertically down to a lower end of the screen to define a refugee path. A predetermined width of a closure flap is associated with the at least one slit for closing the slit with a predetermined overlap between the at least one slit and the closure flap. A main weight bar is horizontally fixed along the lower end of the screen except for the closure flap, and a sub-weight bar is horizontally fixed along the lower end of the closure flap.

10 Claims, 16 Drawing Sheets

WALK-THROUGH TYPE WATERPROOF SCREEN APPARATUS

BACKGROUND OF THE INVENTION

1. Field of the Invention

The present invention relates generally to a fire-limiting and smoke limiting construction for preventing fire from propagating and smoke from diffusing within a building. More specifically, the invention relates to a fire limiting screen arrangement employing a non-combustible or fire-resistive screen formed of a glass fiber fabric or silica cloth or the like, with a walk-through feature permitting people to easily pass therethrough.

2. Description of the Related Art

It has been required to provide fire limit zones and smoke limit zones within a relatively large buildings and to further provide refugee paths so as to prevent fire from propagating and smoke from diffusing, and to facilitate evacuation. Thus, fire-proof bulkheads, smoke screens, fire shutters, fire retarding doors and the like have been provided.

As is well known, a fire shutter is a steel shutter having a fire resistant property. Typically, the fire shutter has a construction in which a plurality of slats are connected via flexible linkages to be rolled up by means of an electric motor or the like. The fire shutter is operative between a normal state where it is rolled up and stored in an upper portion of the boundary of the fire limit and a state where it is pulled down or developed to close an opening of the building upon the occurrence of fire. In view of its nature, the fire shutter may not be built-in a fire retarding door. Once the fire shutter is pulled down or developed, people cannot pass through the shutter. In order to certainly provide a refugee path for people, it becomes necessary to provide the fire retarding door in the vicinity of the fire shutter. Typically, the fire retarding door is designed to be automatically closed upon the occurrence of fire and can be opened at any time in an evacuating direction.

If a large number of fire-proof bulkheads are provided in various places in a building, fire proofing and smoke-proofing performance can be enhanced. However, it is not practical to provide a large number of such fire-proof bulkheads disregarding the original and desired functionality or convenience of use. Furthermore, various factors, such as matching wall surfaces, storage space in the normal state, easiness of evacuation in an emergency, and installation cost, have to be considered by a designer.

SUMMARY OF THE INVENTION

The inventors have made extensive research and development for a fire limiting screen arrangement which can be easy to implement while employing a flexible heat resistive and fire-proofing cloth screen at low cost, requires smaller space for storage, demonstrates relatively high fire-proofing and smoke-retarding performance, and can permit people to pass through when in the closed condition to facilitate evacuation in an emergency.

The basic idea of the invention is a walk through type fire limiting screen arrangement to separate an interior space of the building by means of a fire-proofing screen extending from the ceiling to the floor, and to form one or more slits extending from an intermediate height position between the ceiling surface and the floor surface at appropriate locations for providing refugee paths. By employing flexible silica cloth as the screen, the slit easily can be widened by hand to permit people to pass through.

It has been found that it is not easy to achieve both enhancement of fire-proofing and smoke-proofing performance (enhancing heat isolation and smoke blocking performance) for a fire screen formed with a slit and ease of passage through the slit. Namely, when a person passes through the slit refugee path, the person widens the slit by hand and body. If the widened gap remains after the person has passed through the slit, the relatively wide gap would degrade fire-proofing and smoke-proofing performance significantly. On the other hand, when a measure is taken to quickly restore the original screen state after the person passes through the slit, such measure can serve to interfere with passing through by people.

The present invention has been developed in view of the above and is based on the results of various research and experiments. Therefore, it is an object of the present invention to provide a fire limiting screen arrangement with a walk-through feature, which can be easy to implement by employing a flexible heat resistive and fire-proofing cloth screen at low cost, requires smaller space for storage, demonstrates relatively high fire-proofing and smoke-retarding performance in effectively closing an opening in a building, and can permit people to easily pass through in the closed condition to facilitate evacuation in an emergency.

According to one aspect of the invention, a walk-through type fire-limiting screen arrangement comprises:

- a non-combustible or fire-proof screen drooping or hanging from a ceiling or a beam for isolation of an interior space of a building;
- at least one slit extending vertically down to a lower end of the screen;
- a predetermined width of a closure flap associated with the at least one slit for closing the slit with a predetermined overlap between the slit portion and the closure flap;
- a main weight bar horizontally fixed along the lower end of the screen except for the closure flap;
- a sub-weight bar horizontally fixed along the lower end of the closure flap.

In one embodiment, the closure flap may include mutually separated front side back side flaps, the front side flap and the back side flap being formed with a plurality of slits extending vertically to the lower ends thereof for dividing each flap into a plurality of respective flap strips. The positions of the slits formed in the front side flap are transversely shifted relative to the positions of the slits formed in the back side flap so as not to overlap each other.

The main weight bar may be a single bar member having a bar intermediate portion located right below the closure flap in the screen, which bar intermediate portion is not fixed to the lower end of the screen.

According to another aspect of the invention, a walk-through type fire-limiting screen arrangement comprises:

- a plurality of non-combustible or fire-proof small width screens arranged in alignment and drooping or hanging from a ceiling or a beam for isolation of an interior space of a building;
- at least one slit extending vertically down to the lower ends of the small width screens;
- weight bars horizontally fixed along the lower ends of respective of the smaller width screens;
- at least one of the smaller width screens being formed with a plurality of slits extending vertically to the lower end thereof for defining a refugee path; and
- take-up devices arranged on the ceiling and respectively associated with the smaller width screens for extracting and retracting the screens independently of each other.

In one embodiment, the weight bar fixed to one smaller width screen as a first weight bar may have a cut-out at the front side at the portion where the screen overlaps with an adjacent screen and the weight bar fixed to another smaller width screen located adjacent the one smaller width screen as a second weight bar may have a cut-out at the back side at the portion where the screen overlaps with the one screen.

BRIEF DESCRIPTION OF THE DRAWINGS

The present invention will be understood more fully from the detailed description given herebelow and from the accompanying drawings of preferred embodiments of the invention, which, however, should not be taken to be limitative to the present invention, but are for explanation and understanding only.

In the drawings.

DESCRIPTION OF THE PREFERRED EMBODIMENT

The present invention will be discussed hereinafter in detail in terms of the preferred embodiments of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
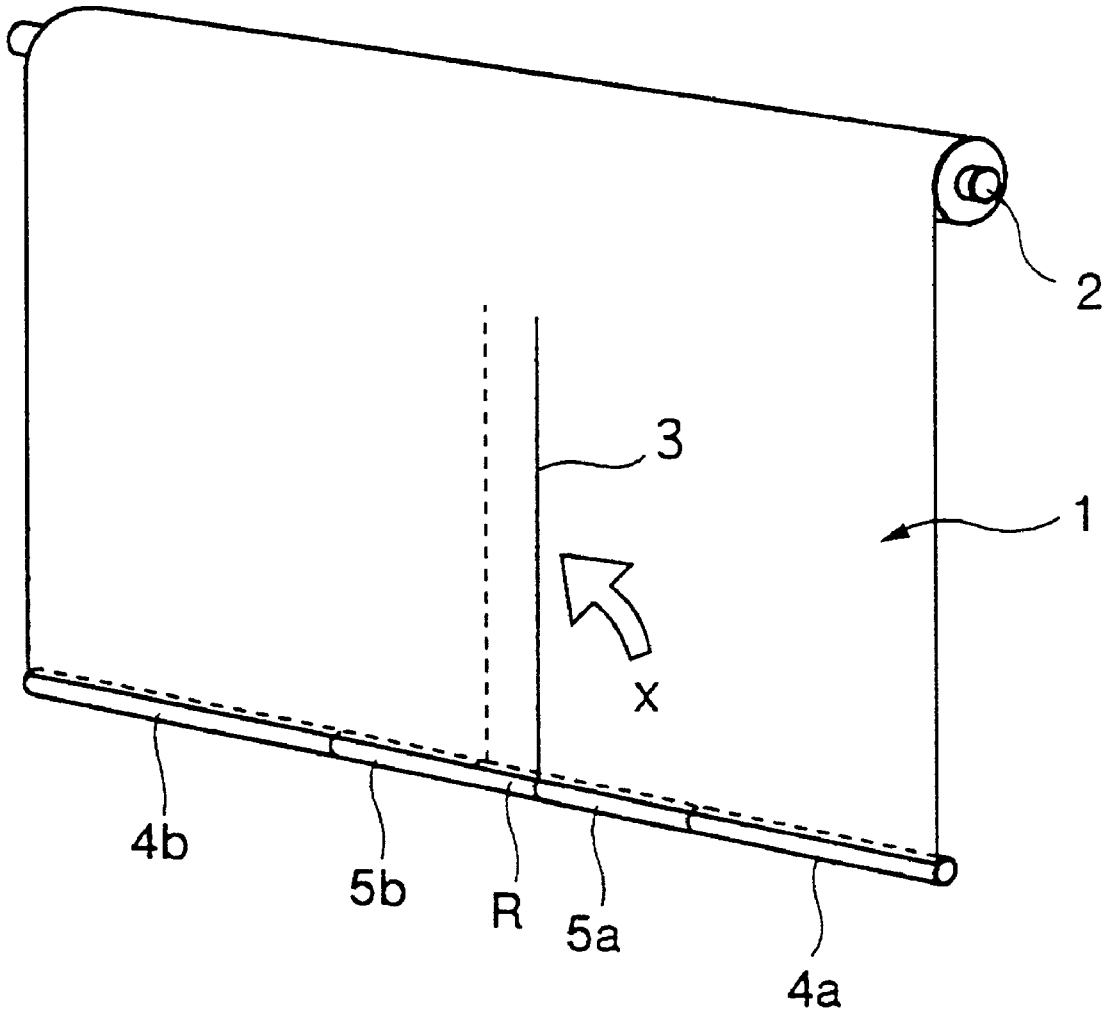
FIG. 1 is a perspective view of the first embodiment of a walk-through type fire limiting screen arrangement according to the present invention.

The general construction of the first embodiment of a walk-through type fire limiting screen arrangement according to the present invention is shown in FIG. 1. The shown fire limiting screen arrangement is primarily constructed with a non-combustible or fire-proof screen 1, such as a glass fiber fabric, silica cloth or the like (hereinafter simply referred to as "fire-proof screen"). The fire-proof screen 1 is rolled up on a shaft 2 arranged horizontally on a ceiling or a beam. The screen droops by its own weight to a floor surface. Opposite sides of the fire-proof screen 1 contact wall surfaces or column surfaces defining an opening in a building. In order to eliminate a gap between the opposite sides of the fire-proof screen 1, guide rails (not shown and discussed later) are provided on the wall surfaces on the column surfaces. Opposite side edges of the fire-proof screen are received within channel grooves of the respective guide rails. The shaft 2 is coupled with a take-up driving device such as an electric motor for extracting and retracting the fire-proof screen. The entire fire-proof screen is rolled up or retracted beneath the ceiling or beam.

At the center portion of the fire-proof screen is formed a slit portion 3 extending vertically from the lower end of the screen. The slit portion 3 separates the screen into left and right portions and defines an opening or door. To prevent formation of a gap, the left and right screen portions are overlapped by an appropriate amount. A preferably overlap is 30 to 50 cm.

Horizontal main weight bars 4*a*, 4*b* are fixed at the lower end of the fire-proof screen 1, except for the left and right portions of a predetermined length thereof adjacent the slit portion 3 forming the screen door opening. In this embodiment, the main weight bar is formed as two separated bar members. The two separate bars 4*a* and 4*b* are fixed to the lower ends of the fire-proof screen in spaced apart relationship on opposite sides of the lower end of the center portion. Left and right independent horizontal sub-weight bars 5*a* and 5*b* are fixed to portions where the two main weight bars 4*a* and 4*b* are not fixed, namely the portions of the predetermined length of the fire-proof screen adjacent the slit portion 3.

The tip ends of the left and right independent sub-weight bars 5*a* and 5*b* corresponding to overlap of the fire-proof screen 1 at the slit portion 3 are overlapped in the horizontal direction over an overlap R. In the overlap R, the bars 5*a* and 5*b* are mutually attracted by the magnetic force of permanent magnets.

In the free condition, the entire fire-proof screen 1 droops vertically by gravity. In this condition, the main weight bars 4*a* and 4*b* and the sub-weight bars 5*a* and 5*b* are in alignment as shown in FIG. 1. Thus, substantially no gap exists adjacent slit portion 3 because of the overlap. The weight of the fire-proof screen 1 and the additional weight of bars 4*a*, 4*b*, 5*a* and 5*b* prevents screen 1 from being opened at slit portion 3 by a slight wind or pressure difference, thus maintaining a stable condition. This provides a substantially high level of fire propagation preventing performance and smoke limiting performance.

In an emergency, a person may easily pass through the slit portion 3 of the fire-proof screen 1. While the screen portions are overlapped at the slit portion 3, by depressing the screen portion located at the backside of the overlap in the direction x of FIG. 1, overlap R at the ends of the sub-weight bars 5*a* and 5*b* are released from each other to form a large gap at the slit portion 3. Thus, people may easily pass through the fire-proof screen. Even from the other side, people may easily pass through the fire-proof screen.

Figure 2:
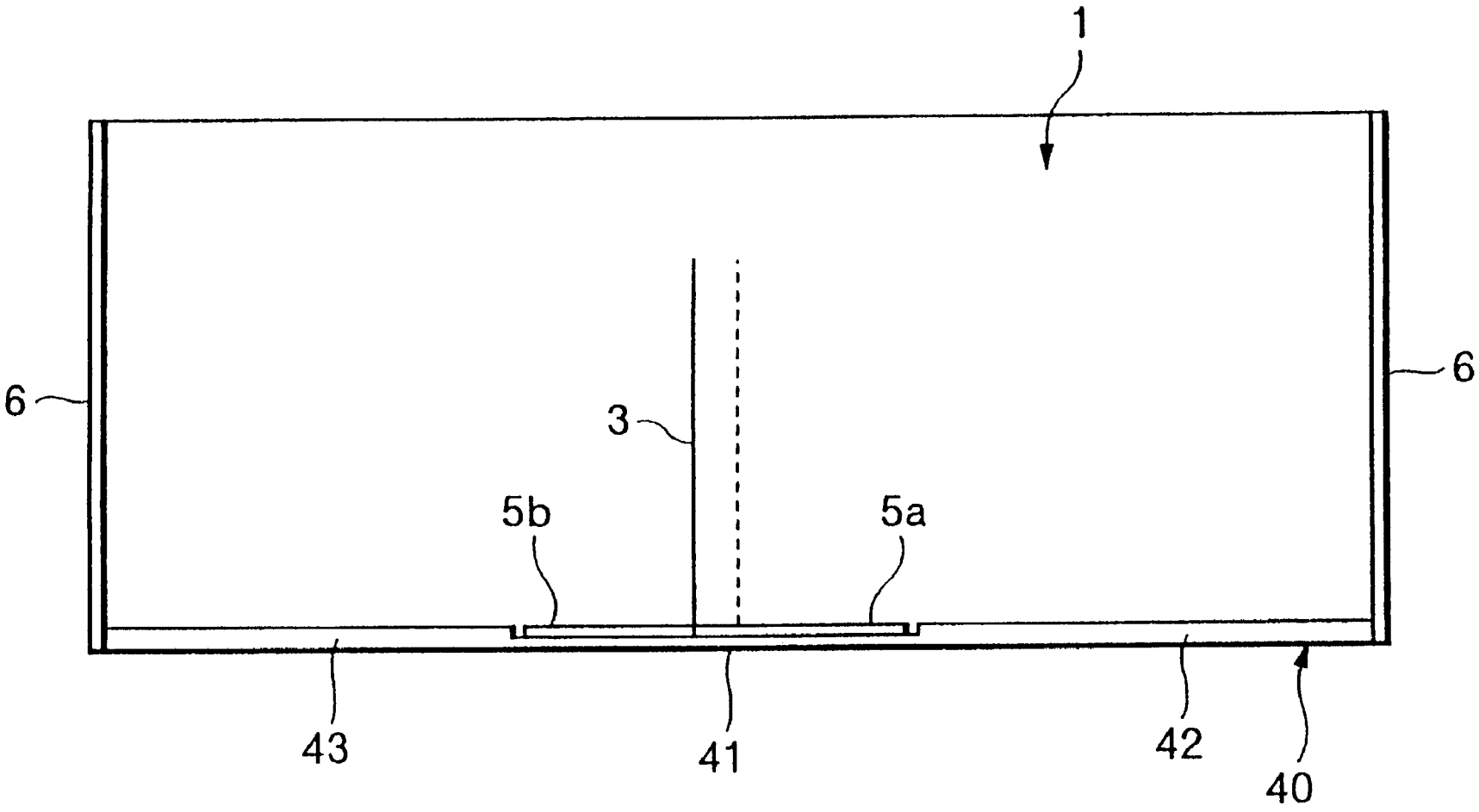
FIG. 2 is a front elevation of a modification of the first embodiment of a walk-through type fire limiting screen arrangement according to the present invention.
Figure 3A:
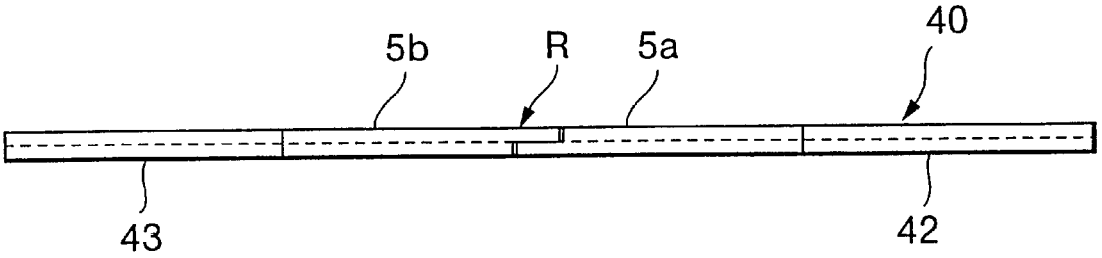
FIGS. 3A and 3B are plan views of the walk-through type fire limiting screen arrangement of FIG. 2.
Figure 3B:
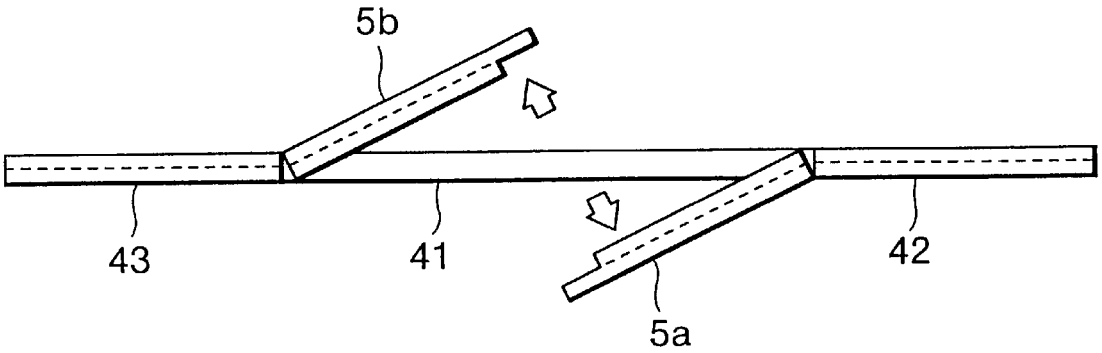

FIGS. 2, 3A and 3B show a modification of the first embodiment of the walk-through type fire limiting screen arrangement according to the present invention. Therein, a main weight bar 40 includes a bar intermediate portion 41 located below the predetermined lengths of the left and right portions of the slit portion 3 at the lower end of the fire-proof screen 1. The bar intermediate portion 41 is integral with bar main bodies 42 and 43 to form an aligned bar. It should be noted that bar main bodies 42 and 43 correspond to the main-weight bars 4*a* and 4*b* in the first embodiment of FIG. 1. The sub-weight bars 5*a* and 5*b* and the bar intermediate portion 41 are magnetically attracted to each other. The reference numeral 6 in FIG. 2 denote guide rails.

Figure 4:
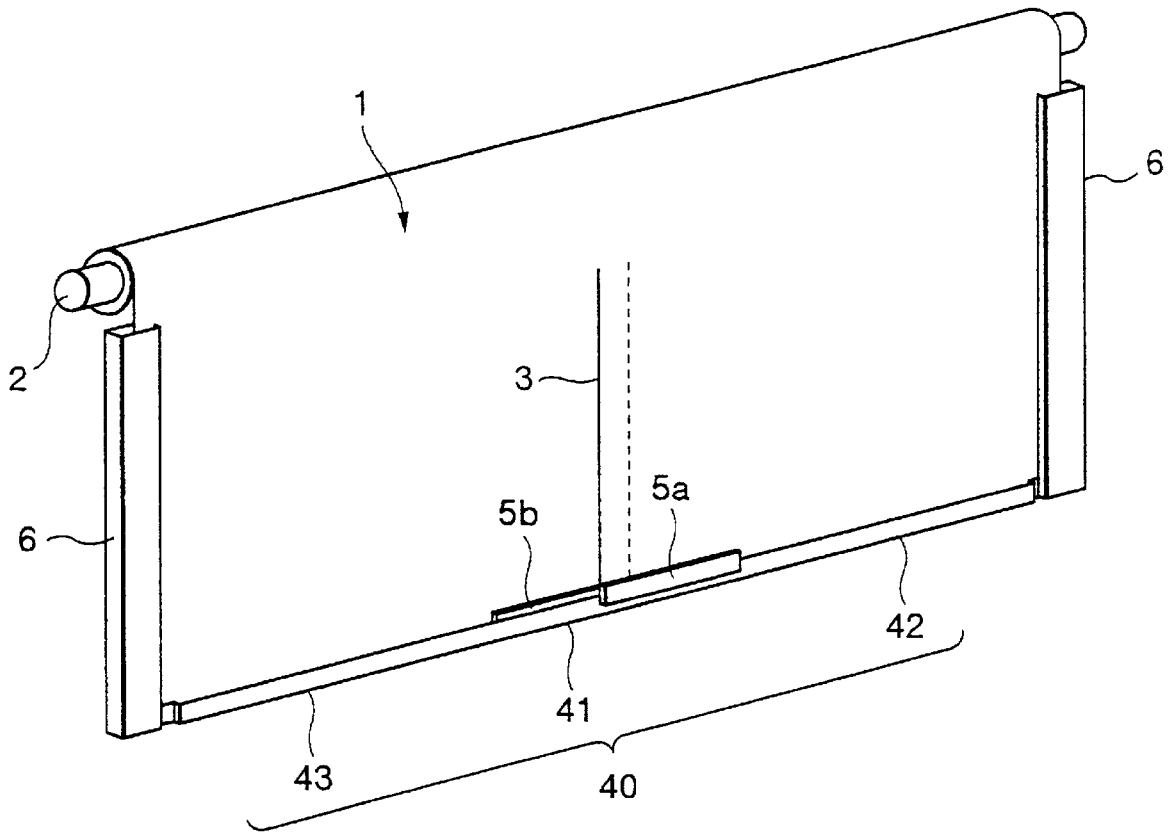
FIG. 4 is a perspective view of another modification of the first embodiment of a walk-through type fire limiting screen arrangement according to the present invention.
Figure 5A:
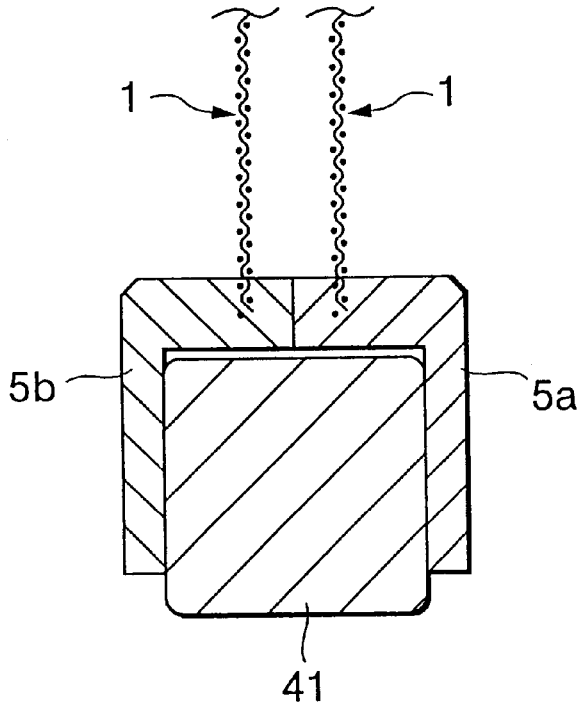
FIGS. 5A and 5B are enlarged partial sections of the walk-through type fire limiting screen arrangement of FIG. 4.
Figure 5B:
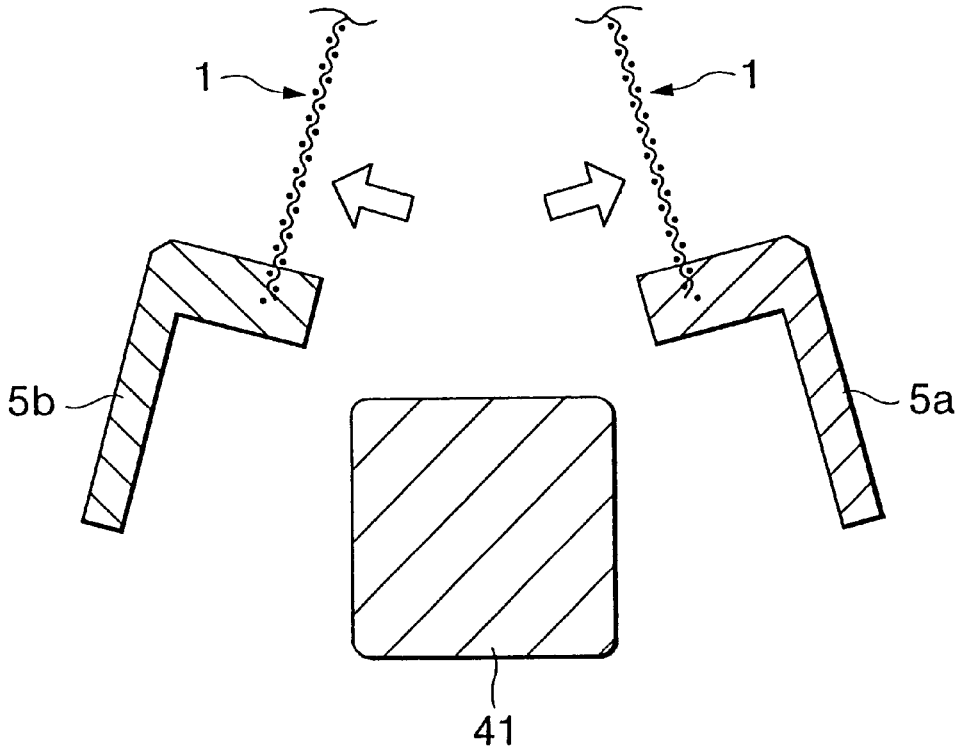

FIGS. 4, 5A and 5B show another modification of the first embodiment of the walk-through type fire limiting screen arrangement according to the present invention. The main weight bar 40 includes a bar intermediate portion 41 located below the portions of the predetermined lengths of the left and right portions of the slit portion 3 at the lower end of the fire-proof screen 1. The bar intermediate portion 41 is integral with bar main bodies 42 and 43 to form an aligned bar. One of left and right sub-weight bars 5*a* and 5*b* that are mutually independent of each other contacts one side of the bar intermediate portion 41, and the other sub-weight bar contacts the other side of the bar intermediate portion 41. The sub-weight bars 5*a* and 5*b* and the bar intermediate portion 41 are mutually attracted to each other by magnetic force of the permanent magnets. As clearly shown in FIG. 4, in order to eliminate gaps between opposite side portions of the fire-proof screen 1, the guide rails 6 are provided vertically on wall surfaces or column surfaces so that the opposite side edge portions of the screen are received within channel grooves of the guide rails 6.

Figure 6:
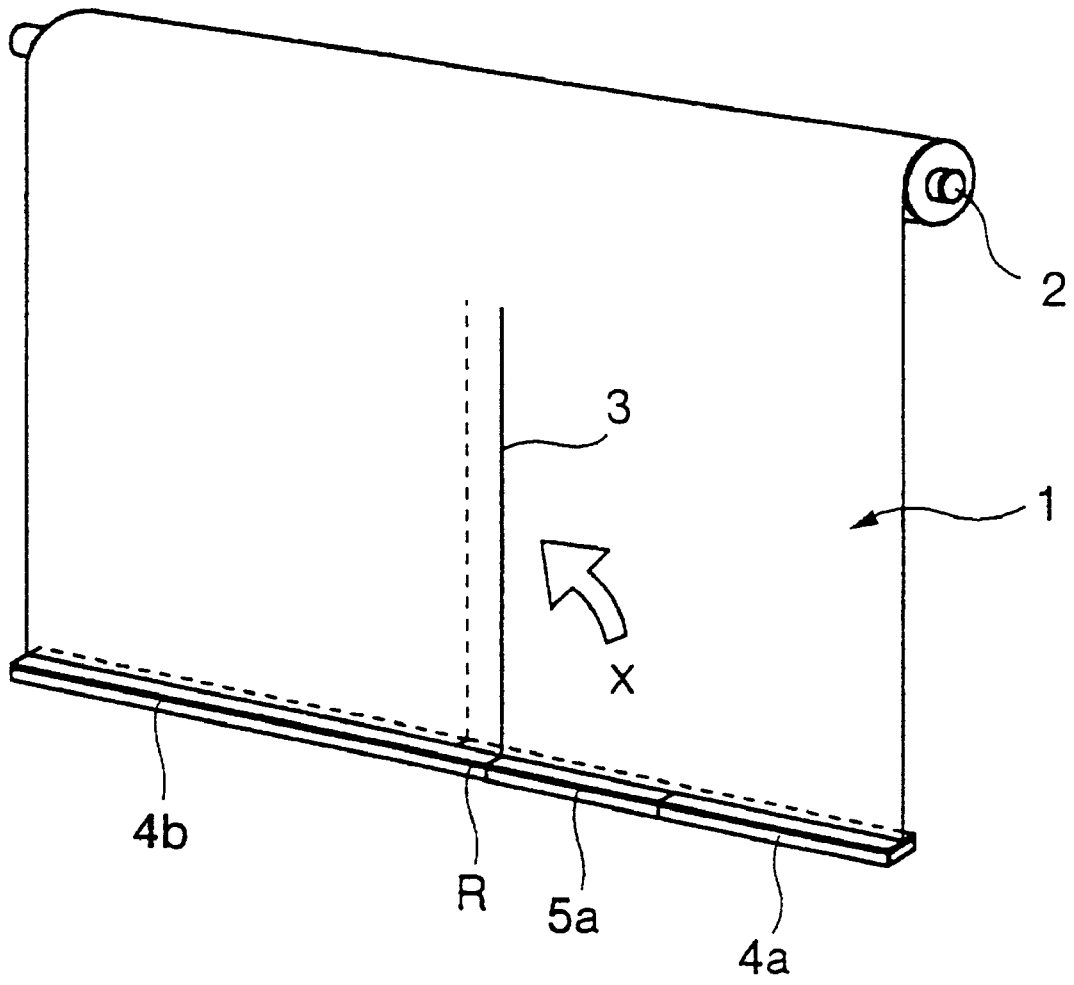
FIG. 6 is a perspective view of a further modification of the first embodiment of a walk-through type fire limiting screen arrangement according to the present invention.

Although a double parting construction has been discussed above, the present invention is, of course, employable with a single swing or parting construction. FIG. 6 shows a further modification of the first embodiment employing such a single swing type screen arrangement. In this arrangement, only one sub-weight bar 5*a* is provided.

Figure 7A:
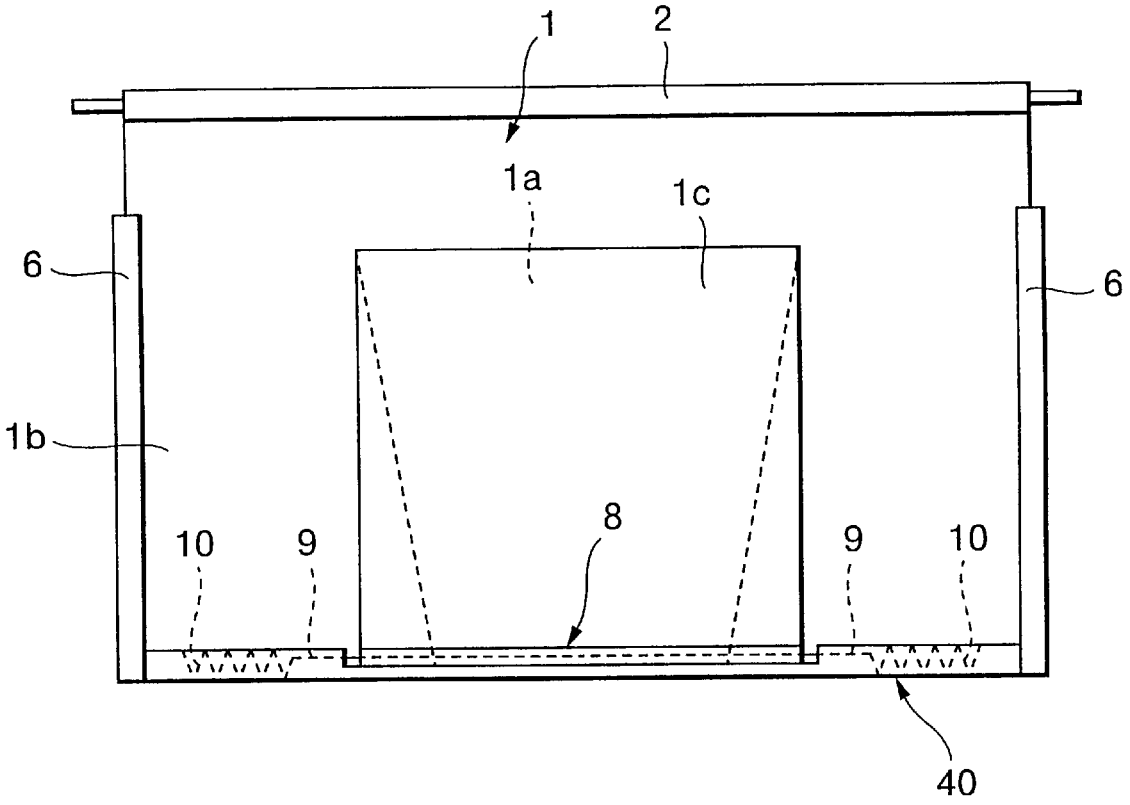
FIG. 7A is a front elevation of the second embodiment of a walk-through type fire limiting screen arrangement according to the present invention.
Figure 7B:
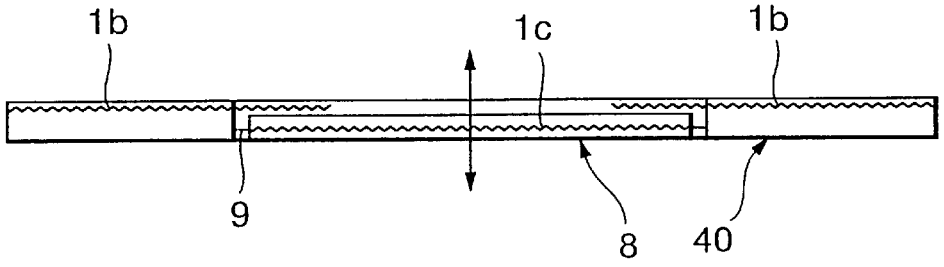
FIG. 7B is a plan view of the walk-through type fire limiting screen arrangement of FIG. 7A.

FIGS. 7A and 7B show the second embodiment of the walk-through type fire-limiting screen arrangement according to the present invention. The screen 1 has a screen main body portion 1*b* which has formed therein an opening 1*a* to provide a path or access, at a predetermined position. The opening 1*a* extends to the lower end of the screen main body portion 1*b*. The screen 1 also includes a closure flap portion 1*c* which is closes the opening 1*a* and is integral at the upper end thereof with the screen main body portion 1*b*. The width of the opening 1*a* becomes smaller toward the bottom thereof. The closure flap portion 1*c* has a uniform width. Thus, widths of overlap of the closure flap portion 1*c* with the screen main body portion 1*b* is greater toward the bottom thereof. Smaller overlap will reduce interference or resistance to passage through the screen.

Main weight bar 40 extends horizontally substantially over the entire width of the lower end of the screen 1. Main weight bar 40 is fixed to the lower end of the screen main body portion 1*b* but is separated from the closure flap portion 1*c* that closes the opening 1*a*. On the lower end of the closure flap portion 1*c* is fixed horizontal sub-weight bar 8. The upper portion of main weight bar 40 located just below the closure flap portion 1*c* is cut-out. A thinner portion of the main weight bar 40 is substantially parallel to and in contact with the sub-weight bar 8.

The sub-weight bar 8 is constrained from movement relative to the main weight bar 40, and may be displaced by a significant amount relative to the main weight bar only by application of external force such as when a person passes through the opening. Unless such external force is exerted, the sub-weight bar contacting the main weight bar maintains the closure flap portion 1*c* closing the opening 1*a*.

Figure 8A:
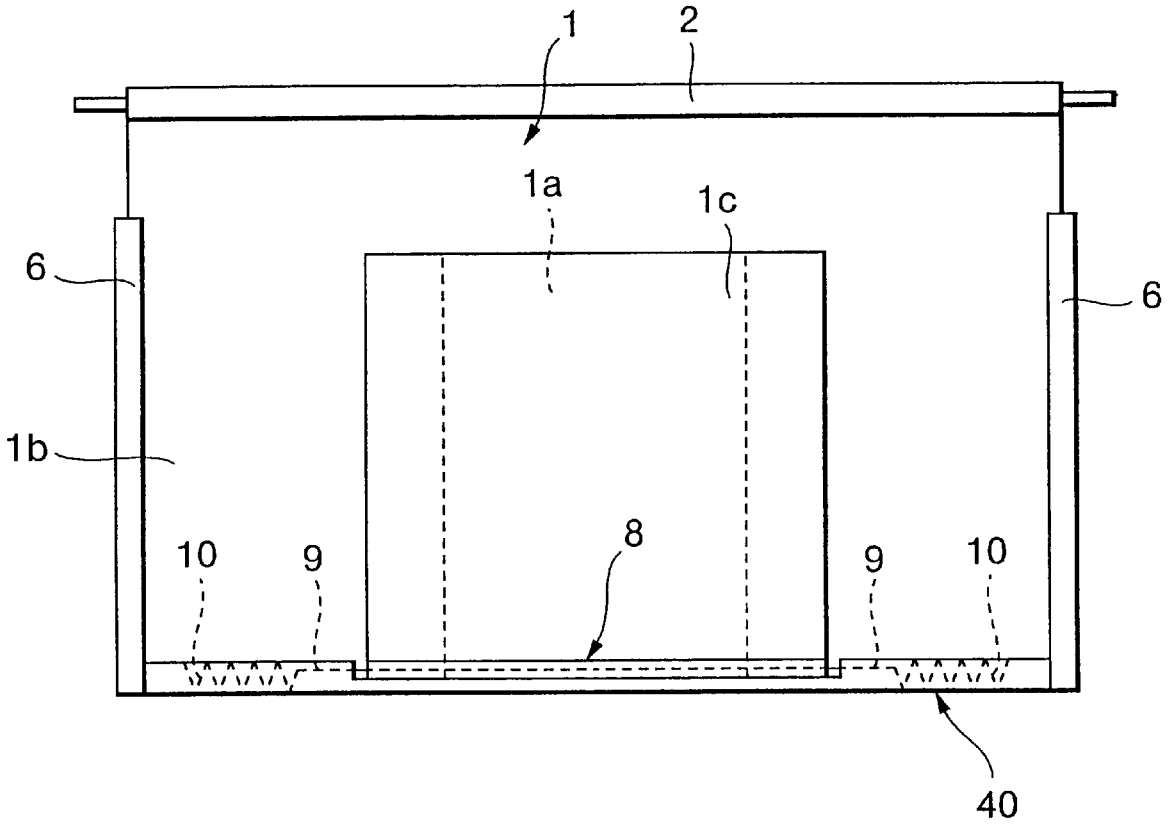
FIG. 8A is a front elevation of a modification of the second embodiment of a walk-through type fire limiting screen arrangement according to the present invention.
Figure 8B:
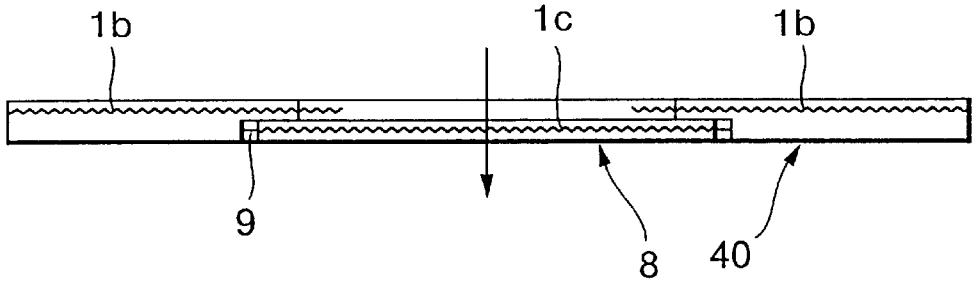
FIG. 8B is a plan view of the walk-through type fire limiting screen arrangement of FIG. 8A.

FIGS. 8A and 8B show a modification of the second embodiment. The sub-weight bar 8 is located at the front side of the main weight bar 40 for facilitating passing a person through from the back side of the screen 1 to the front side. Against force exerted in the opposite direction, i.e. from front side to the back side, the sub-weight bar 8 abuts the main weight bar to prevent the closure flap portion 1*c* from being opened. By making the opening a one-way opening, fire propagation prevention and smoke blocking performance can be enhanced. The closure flap portion 1*c* is provided in front of the screen main body portion 1*b* and has overlapping portions of greater and uniform width. Such greater overlap contributes to enhancement of propagation prevention and smoke blocking performance while ease passage is not sacrificed.

Figure 9:
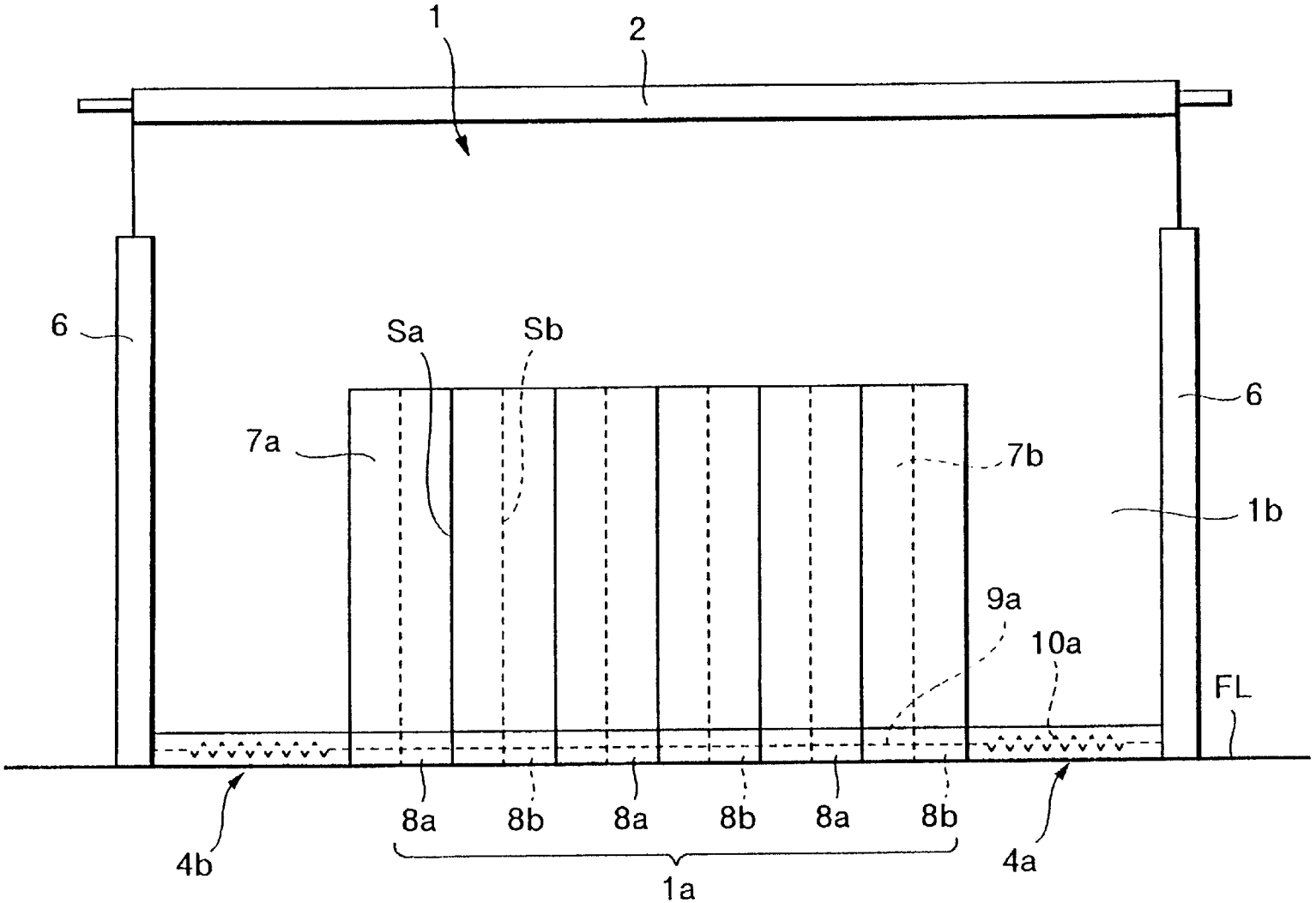
FIG. 9 is a front elevation of the third embodiment of a walk-through type fire limiting screen arrangement according to the present invention.
Figure 10:
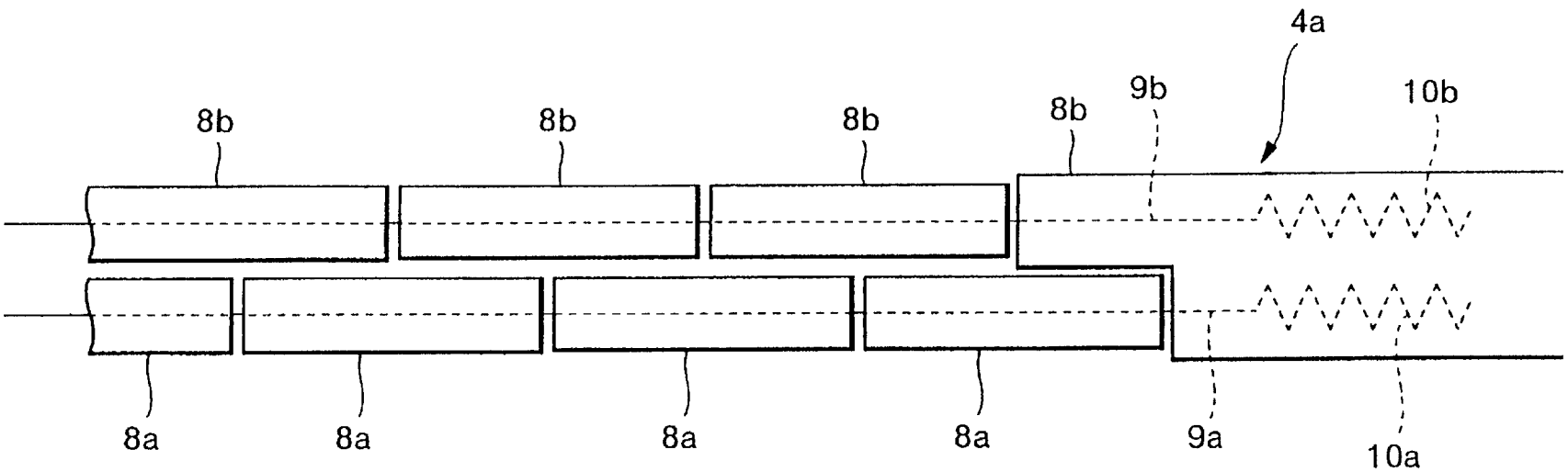
FIG. 10 is a plan view of the walk-through type fire limiting screen arrangement of FIG. 9.

FIGS. 9 and 10 show the third embodiment of the walk-though type fire-limiting screen arrangement according to the present invention. A closure flap portion for closing opening 1*a* of screen main body portion 1*b* is provided at the center thereof. The closure flap portion is formed by a front side flap and a back side flap overlapping with each other. Respective of the front side flap and the back side flap are formed with a plurality of slits 5*a* and 5*b*, respectively, extending vertically from the lower ends of the flaps and thus are divided into a plurality of flap strips. The flap strips of the front side flap will be referred to as front side flap strips 7*a* and the flap strips of the back side flap will be referred to as rear side flap strips 7*b*.

On the lower ends of the front side flap strips 7*a* are horizontally fixed respective independent short sub-weights 8*a*. Similarly, on the lower ends of the rear side flap strips 7*b* are horizontally fixed respective independent short sub-weights 8*b*. Also, on the lower end of the right side portion of the screen main body 1*b* is fixed horizontally a right side main weight bar 4*a*, and on the lower end of the left side portion of the screen main body 1*b* is horizontally fixed a left side main weight bar 4*b*. In the normal condition where the entire screen droops by its own weight, respective sub-weight bars 8*a* are aligned and respective sub-weight bars 8*b* are aligned. These two alignments of the sub-weight bars 8*a* and 8*b* are arranged in parallel and in contact with each other and are wholly in alignment with the left and right main weight bars 4*a* and 4*b*.

Horizontal through openings extend through lower end portions of the sub-weight bars 8*a* and 8*b*. Through openings which are to be aligned with the through openings of the sub-weight bars 8*a* and 8*b* are formed in the left and right main weight bars 4*a* and 4*b*. Through a series of through holes of respective sub-weight bars 8*a* (8*b*) is inserted a respective single wire 9*a* (9*b*). Opposite ends of the wire 9*a* (9*b*) are inserted into the through openings of the main weight bars 4*a* and 4*b*. Within the holes of the main weight bars 4*a* and 4*b*, respective coil springs 10*a*, 10*b* are connected to opposite ends of the wires 9*a*, 9*b*. The other end of each coil spring 10*a*, 10*b* is fixed to the respective main weight bar 4*a*, 4*b*. The wires 9*a*, 9*b* and the two coil springs 10*a*, 10*b* at opposite ends thereof are resilient expansion members of coupling members.

In the construction set forth above, the entire screen droops by the weights of the main weight bars 4*a* and 4*b* and the sub-weight bars 8*a* and 8*b* to be positioned in a substantially stable condition. By means of the wires 9*a* and 9*b* and the coil springs 10*a* and 10*b*, respective sub-weight bars 8*a* and 8*b* and the main weight bars 4*a* and 4*b* are coupled in alignment and dynamically loosely constrained. Since the wires 9*a*, 9*b* extend through the through openings of respective sub-weight bars 8*a*, 8*b* and the main weight bars 4*a* and 4*b*, an appropriate tension is applied by the resilient force of the coil springs 10*a*, 10*b* and respective sub-weight bars 8*a*, 8*b* and the main weight bars 4*a* and 4*b* are aligned in-line. In this condition, a slight gap may be formed in the closure flap portion. The flap strips should not move with slight wind pressure or a pressure difference, and a stable attitude will be maintained. Thus, a substantially high level of fire propagation preventing performance and smoke blocking performance can be realized.

On the other hand, when a person passes through the closure strap portion, he may insert a hand or body through the slits 5*a* and 5*b* to separate the flap strips 7*a* and 7*b*. This external force is transmitted to the flap strips 7*a* and 7*b* and the sub-weight bars 8*a* and 8*b* to the wires 9*a* and 9*b* to expand the coil springs 10*a* and 10*b*. Namely, the wires 9*a* and 9*b* are expanded at the portions of the flap strips 7*a* and 7*b* that are separated to cause displacement on specific sub-weight bars 8*a* and 8*b* from the normal positions thereof to widen the slits 5*a* and 5*b* to permit the refugee to pass therethrough.

Once the refugee passes through, the spring force of the coil springs 10*a* and 10*b* and the weights of sub-weight bars 8*a* and 8*b* and main weight bars 4*a* and 4*b* cause the weight bars to be quickly aligned and returned to the normal positions thereof. Thus, the flap strips 7*a* and 7*b* are returned to the normal positions thereof to achieve high fire propagation preventing performance and smoke blocking performance.

Figure 11:
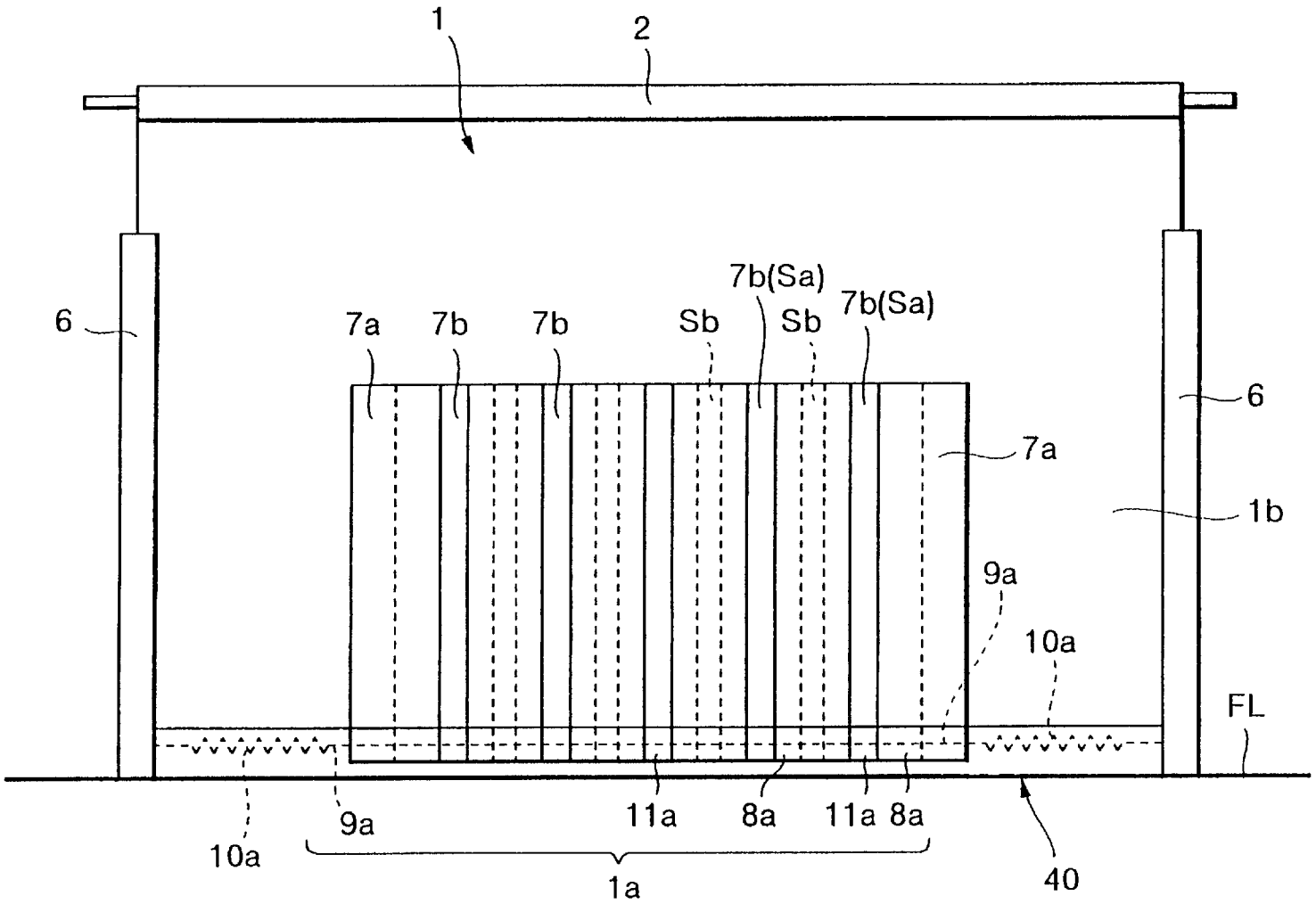
FIG. 11 is a front elevation of a modification of the third embodiment a walk-through type fire limiting screen arrangement according to the present invention.
Figure 12:
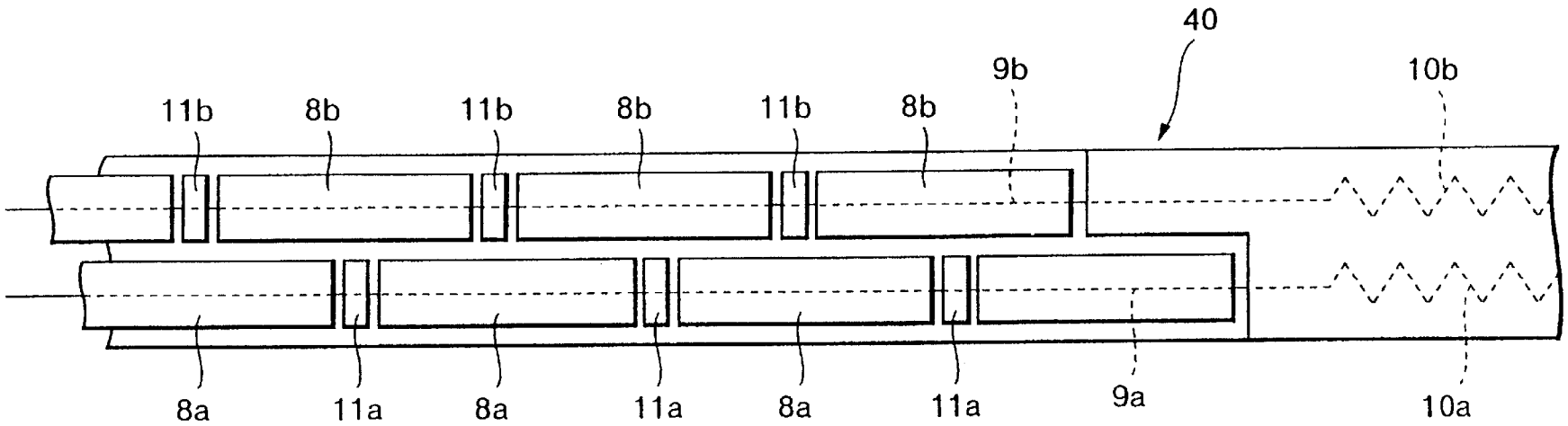
FIG. 12 is a plan view of the walk-through type fire limiting screen arrangement of FIG. 11.
Figure 13:
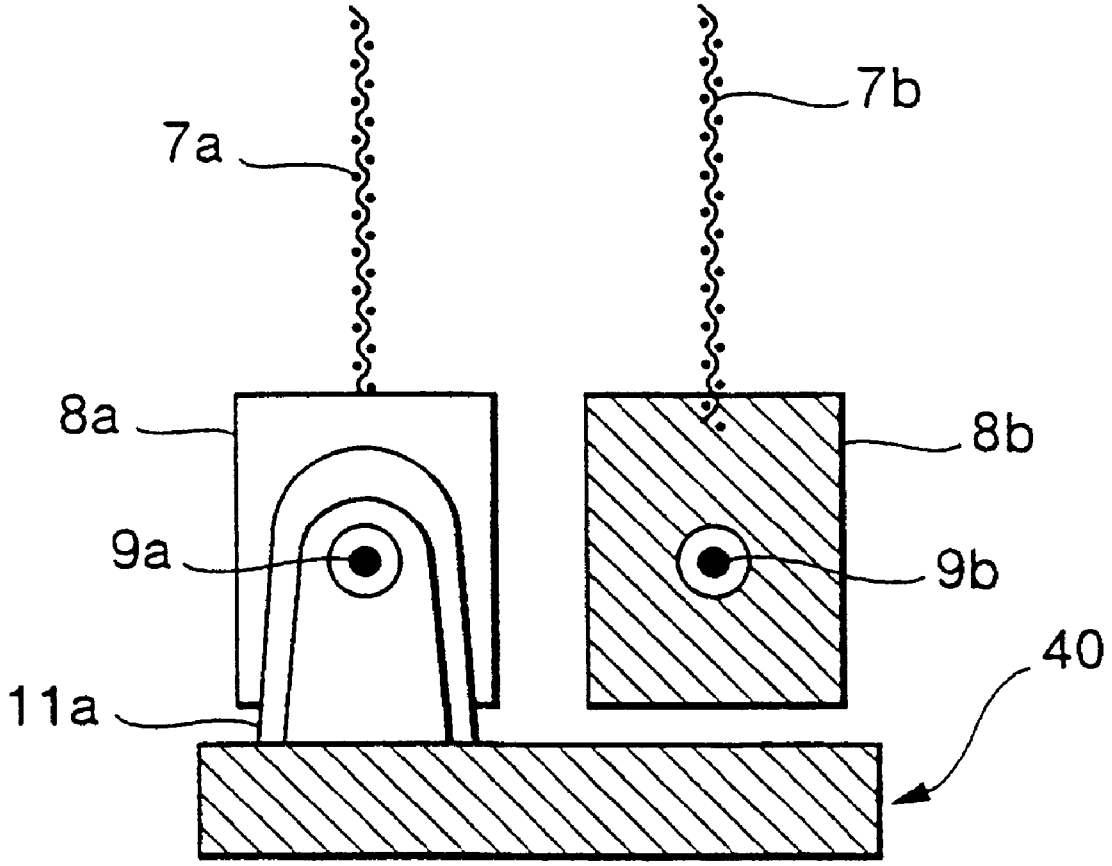
FIG. 13 is an enlarged section of the major part of the walk-through type fire limiting screen arrangement of FIG. 12.

FIGS. 11, 12 and 13 show modifications of the third embodiment of the walk-through type fire limiting screen arrangement according to the present invention. The main weight bar 40 is fixed to the lower end of the screen main body portion 1*b*. However, the main weight bar 40 is not fixed to the front side flap strips 7*a* and the back side flap strips 7*b* which, in combination, form the closure flap portion. Independently of the main weight bar 40, mutually independent short sub-weight bars 8*a* are horizontally fixed on the lower ends of the front side flap strips 7*a*. Similarly, mutually independent short sub-weight bars 8*b* are horizontally fixed on the lower ends of the back side flap strips 7*b*.

The upper portion of the main weight bar 40 at a position right below the closure strip portion is cut-out to be thinner than the portions thereof fixed to the screen main body portion 1*b*. On the central cut-out portion of the main weight bar 40, the sub-weight bars 8*a* and the sub-weight bars 8*b* respectively arranged in alignment are received in parallel relationship to each other.

Horizontally extending through openings are formed through the sub-weight bars 8*a* and 8*b*. Through openings which are to be aligned with the through openings of the sub-weight bars 8*a* and 8*b* are formed in the main weight bar 40. Single wires 9*a*, 9*b* extend through series of through holes of respective sub-weight bars 8*a*, 8*b*. Opposite ends of the wires 9*a*, 9*b* are inserted into the through openings of the main weight bar 40. Within the holes of the main weight bar 40, coil springs 10*a*, 10*b* are connected to opposite ends of the wires 9*a*, 9*b*. Others end of the coil springs 10*a*, 10*b* are fixed to the main weight bar 40. The wires 9*a*, 9*b* and two coil springs 10*a*, 10*b* are resilient expansion members of coupling members.

Main weight bar 40 has stopper members 11*a*, 11*b* formed at positions located between adjacent sub-weight bars 8*a* and 8*b*. The wire 9*a* between the sub-weight bars 8*a* and 8*a* is inserted through the stopper members 11*a*, and the wire 9*b* between the sub-weight bars 8*b* and 8*b* is inserted through the stopper members 11*b*.

The sub-weight bars 8*a* and 8*b* are moved significantly in response to application of an external force, thus causing associated displacement of the flap strips 7*a* and 7*b* a permit passage therethrough. Upon removal of the external force, respective sub-weight bars 8*a* and 8*b* are moved to normal positions to close the closure flap portion.

Figure 14:
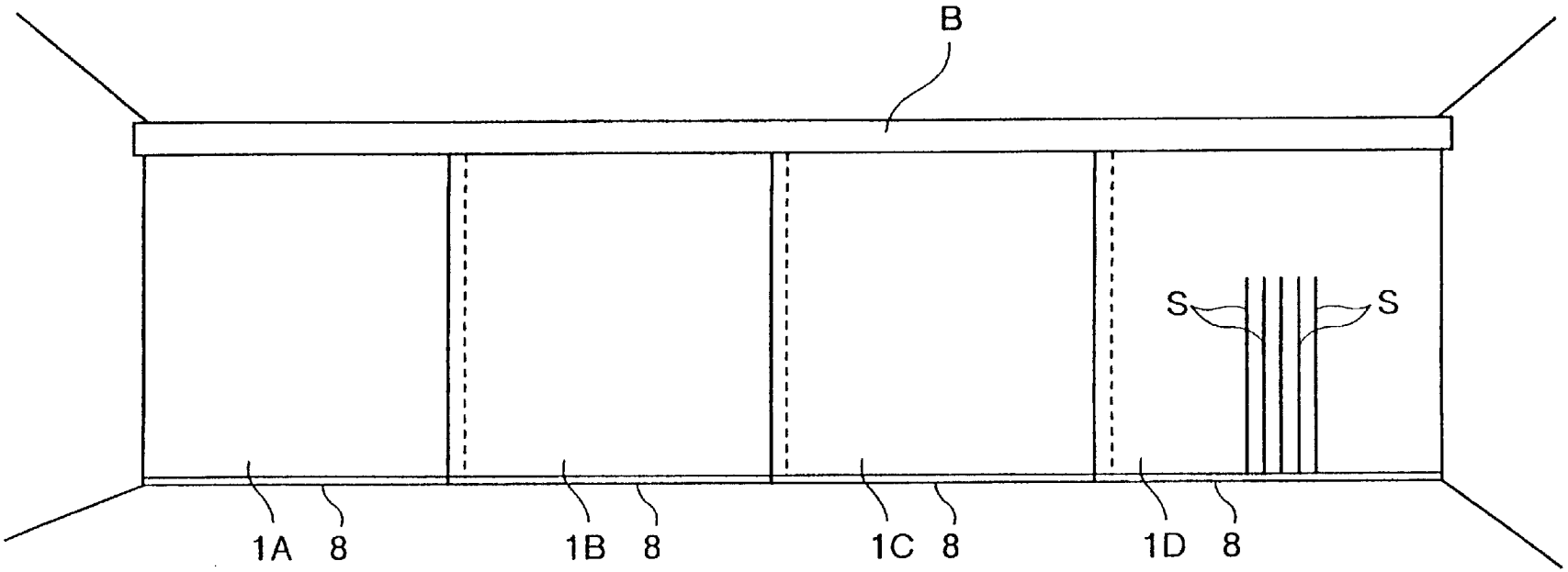
FIG. 14 is a perspective view of the fourth embodiment of a walk-through type fire limiting screen arrangement according to the present invention.
Figure 15:
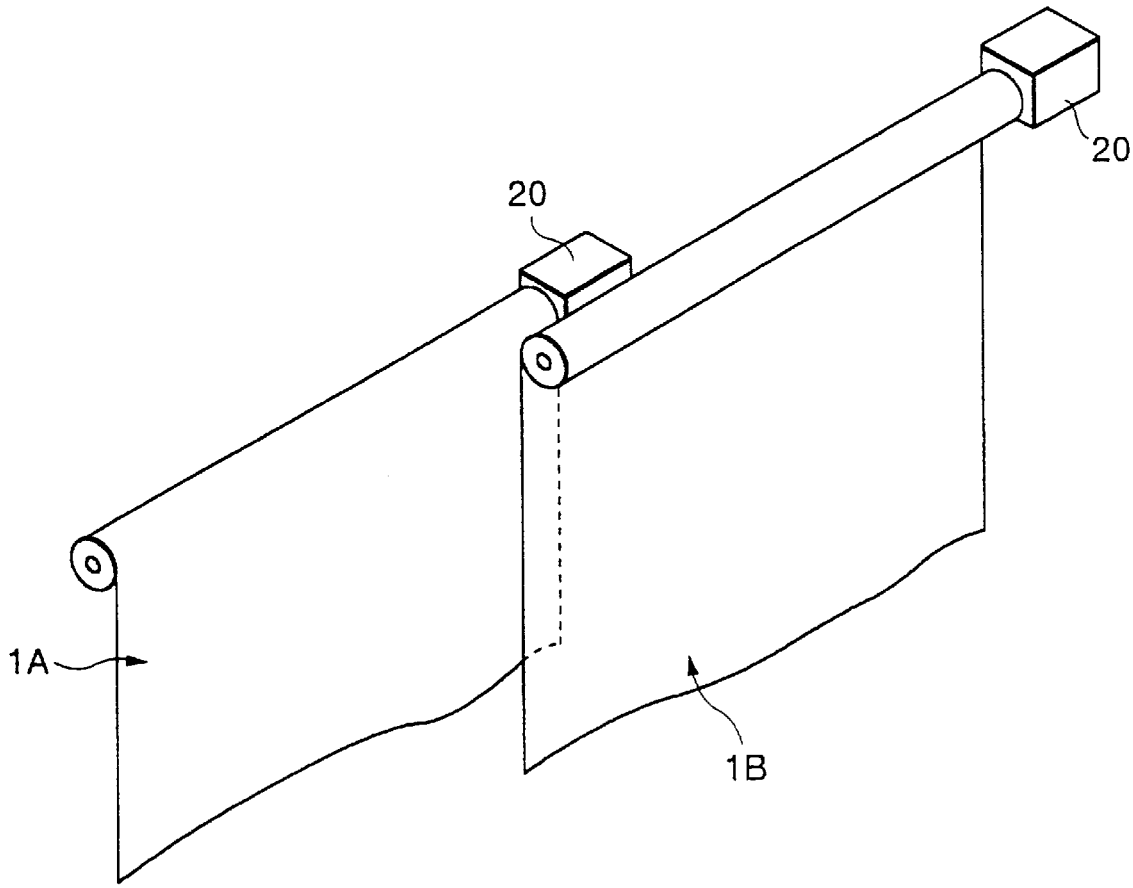
FIG. 15 is an enlarged perspective view of the major part of the walk-through type fire limiting screen arrangement of FIG. 14.
Figure 16:
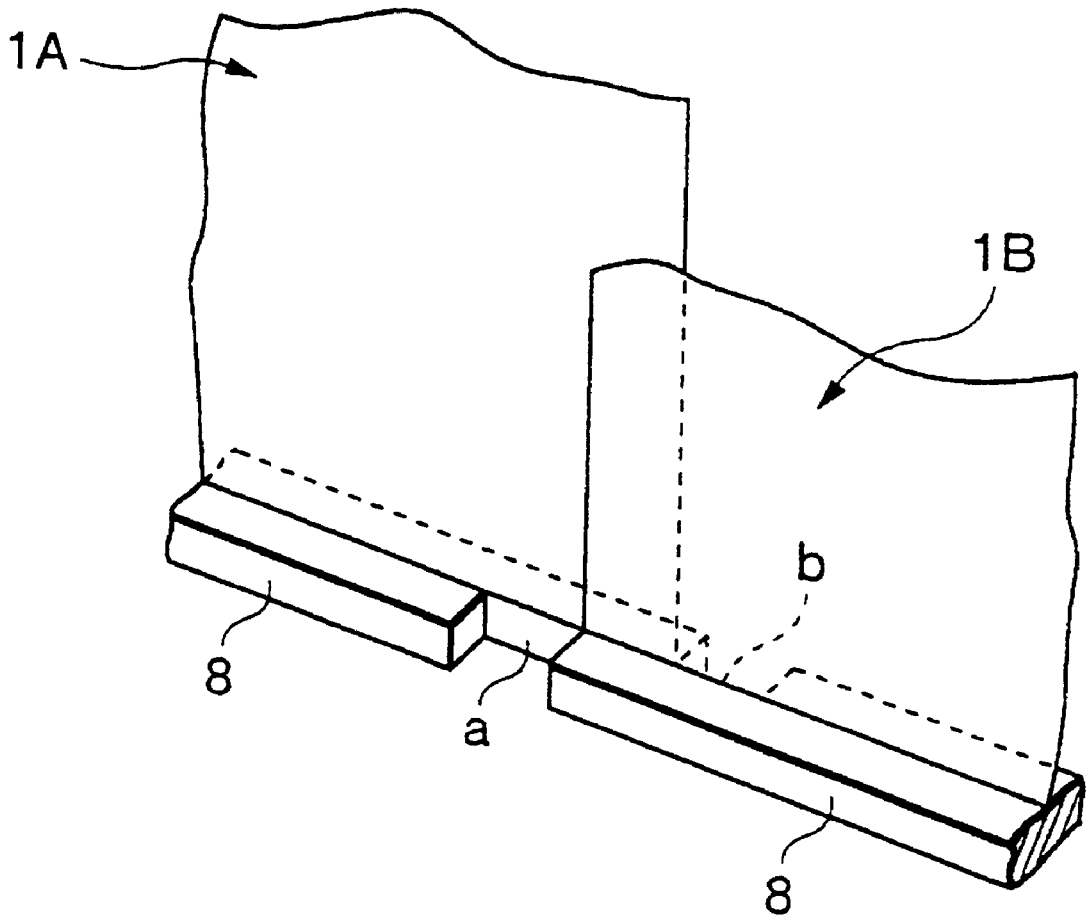
FIG. 16 is an enlarged perspective view of another major part of the walk-through type fire limiting screen arrangement of FIG. 14.

FIGS. 14, 15 and 16 show the fourth embodiment of the walk-through type fire-limiting screen arrangement according to the present invention. The fire-limiting screen is formed by four smaller width screens 1A, 1B, 1C and 1D arranged in horizontal alignment. This type of arrangement is particularly suitable for separating relatively large spaces in a building. In a practical embodiment, respective smaller width screens 1A to 1D may have a width of about 8*m* and a height of about 5*m*. Side edge portions of respective smaller width screens may overlap with each other by an extent of 50 cm.

Each smaller width screen 1A to 1D droops from a take-up device 20 housed within a storage box B arranged on the ceiling portion of the building. As shown in FIG. 15, independent take-up devices 20 are provided for each of the smaller width screens 1A to 1D for taking-up each individual screen independently of the others. A length of each of respective take-up shafts is about 8*m* substantially corresponding to the width of the smaller width screens 1A to 1D. Thus, four take-up devices 20 are provided. Adjacent take-up devices 20 are arranged in an offset manner relative to drooping planes along which the smaller width screens 1A to 1D droop. Since the take-up devices 20 are alternately arranged at opposite sides of the drooping planes, the take-up directions of the screens are alternated so that the all of the four smaller width screens 1A to 1D may droop along substantially the same drooping plane. With this arrangement, even when the smaller width screens are arranged with overlapping the side edges, the take-up devices 20 for adjacent screens will never interfere with each other. Furthermore, the smaller width screens 1A to 1D droop substantially vertically along substantially the same plane. The take-up shaft of each take-up device may be driven by an electric motor or the like for extracting and retracting the respective screen. When taken up or retracted, the smaller width screens 1A to 1D are housed within the storage box B, and when extracted, the screens 1A to 1D droop down to separate the interior space of the building. Of course, each of four individual take-up devices 20 can be controlled independently. Therefore, the four smaller width screens 1A to 1D may be extracted and retracted independently of the other.

As shown in FIG. 16, on the lower ends of respective of the smaller width screens 1A to 1D are fixed respective horizontal independent weight bars 8. By the weight of the weight bar 8, an appropriate tension force can be exerted on each of the smaller width screens so that the screens as combined may form smooth plane and will not be moved by wind or the like.

Furthermore, as shown in FIG. 16, at the overlap between adjacent smaller width screens, e.g. 1A and 1B, the weight bar 8 of the smaller width screen 1A is partly cut-out at the front side (hereinafter referred to as cut-out portion a). On the other hand, the weight bar 8 of the smaller width screen 1B is partly cut-out at the back side (hereinafter referred to as cut-out portion b). The cut-out portions a and b are complementary. With such arrangement, the screens 1A and 1B may be placed in a tightly contacted state. Of course, the same is true for all of the other overlapping portions.

As shown in FIG. 14, the smaller width screen 1D is formed with a plurality of slits S extending vertically from an intermediate position between the upper and lower ends of the screen. The portion of the screen 1D where the slits S are formed may define a path through which a person may easily pass. Since the smaller width screens are formed with flexible cloth, a person may easily pass through the path by flaring the flap strips separated by the slits. The clearance resulting from such flaring of the flap strips is sufficient to permit a person to pass. When the fire-limiting screen is formed by the smaller width screen 1A to 1D, the portion where a plurality of slits is formed may serve as a path which corresponds to the fire retarding door. The position of paths may be set depending upon the condition of the of the interior space or other factors.

According to the present invention, a relatively large space can be separated by arranging a series of smaller width screens to define the fire-limit or smoke limit. Since respective screens may be extracted and retracted and opened and closed, even when one is closed by the weight bar, upon the occurrence of fire a person may open the weight bar. When one or more persons must escape, they may pass by lifting the weight bar. Since the smaller width screens may be combined to form the partition with fire-resistance, each individual screen may be taken up or drooped down independently, and a highly practical arrangement can be achieved.

The take-up device for each screen can be operated independently of the others and can be made small. The take-up device thus can be fabricated easily at low cost. Furthermore, the weight bars provided on the lower ends of respective smaller width screens may be combined as a single bar so that the screens when drooped down are tightly in contact. Thus, isolation performance, fire-proofing limit performance, smoke limit performance and the like will not be degraded.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as being limited to the specific embodiments set forth above but to include all possible embodiments which can be embodied within a scope encompassed and equivalents thereof with respect to the features set forth in the appended claims.

What is claimed is:

1. A walk-through type fire-limiting screen arrangement comprising:

a non-combustible or fire-proof screen to hang from a ceiling or a beam for isolation of an interior space of a building;

at least one slit extending vertically down to a lower end of said screen;

a predetermined width of closure flap associated with said at least one slit for closing said slit with a predetermined overlap between said screen and said closure flap;

a main weight bar horizontally fixed along said lower end of said screen, said main weight bar comprising a single bar member having a bar intermediate portion located right below said closure flap, said bar intermediate portion not being fixed to said lower end of said screen; and a sub-weight bar horizontally fixed along a lower end of said closure flap.

2. A walk-through type fire-limiting screen arrangement as set forth in claim 1, wherein said closure flap includes mutually separated front side and back side flaps, said front side flap and said back side flap each being formed with a plurality of slits extending vertically to lower ends for dividing said flaps into respective pluralities of flap strips, and positions of said slits formed in said front side flap being transversely shifted relative to positions of said slits formed in said back side flap so as not to overlap each other.

3. A walk-through type fire limiting screen arrangement as set forth in claim 2, wherein each of said sub-weight bars fixed to lower ends of said flap strips of said front side flap are connected to said main weight bar by a resilient expandable member to be arranged substantially in alignment, and each of said sub-weight bars fixed to lower ends of said flap strips of said back side flap are connected to said main weight bar by a resilient expandable member to be arranged substantially in alignment.

4. A walk-through type fire-limiting screen arrangement comprising:

a non-combustible or fire-proof screen to hang from a ceiling or a beam for isolation of an interior space of a building;

at least one slit extending vertically down to a lower end of said screen;

a predetermined width of closure flap associated with said at least one slit for closing said slit with a predetermined overlap between said screen and said closure flap;

a main weight bar horizontally fixed along said lower end of said screen; and a sub-weight bar horizontally fixed along a lower end of said closure flap, said sub-weight bar being loosely constrained with respect to said main weight bar by a coupling means to permit movement of said sub-weight bar relative to said main weight bar in response to an external force.

5. A walk-through type fire-limiting screen arrangement as set forth in claim 4, wherein said closure flap includes mutually separated front side and back side flaps, said front side flap and said back side flap each being formed with a plurality of slits extending vertically to lower ends for dividing said flaps into respective pluralities of flap strips, and positions of said slits formed in said front side flap being transversely shifted relative to positions of said slits formed in said back side flap so as not to overlap each other.

6. A walk-through type fire limiting screen arrangement as set forth in claim 5, wherein each of said sub-weight bars fixed to lower ends of said flap strips of said front side flap are connected to said main weight bar by a resilient expandable member to be arranged substantially in alignment, and each of said sub-weight bars fixed to lower ends of said flap strips of said back side flap are connected to said main weight bar by a resilient expandable member to be arranged substantially in alignment.

7. A walk-through type fire-limiting screen arrangement as set forth in claim 4, wherein said main weight bar is a single bar member having a bar intermediate portion located right below said closure flap, said bar intermediate portion not being fixed to said lower end of said screen.

8. A walk-through type fire-limiting screen arrangement as set forth in claim 4, wherein said coupling means comprises a combination of a permanent magnet and a magnetic body for magnetically establishing engagement between said main weight bar and said sub-weight bar.

9. A walk-through type fire-limiting screen arrangement as set forth in claim 4, wherein said coupling means a resiliently expandable member connecting said main weight bar and said sub-weight bar.

10. A walk-through type fire-limiting screen arrangement as set forth in claim 4, wherein said overlap between each side of said closure flap and said screen gradually increases toward said lower end of said screen.

* * * * *

UNITED STATES PATENT AND TRADEMARK OFFICE

CERTIFICATE OF CORRECTION

PATENT NO. : 6,070,640
DATED : June 6, 2000
INVENTOR(S) : Yasuyuki Miyagawa et al.

It is certified that error appears in the above-identified patent and that said Letters Patent is hereby corrected as shown below:

Title page,
Item [54], change "WALK-THROUGH TYPE OF WATERPROOF SCREEN APPARATUS" to -- FIRE LIMITING SCREEN ARRANGEMENT WITH WALK-THROUGH FEATURE --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*